US007041001B1

(12) United States Patent
Rogers

(10) Patent No.: US 7,041,001 B1
(45) Date of Patent: May 9, 2006

(54) GOLF CLUB REST

(76) Inventor: Frederick John Rogers, 4062 Canal Dr., Mobile, AL (US) 36619

( * ) Notice: Subject to any disclaimer, the term of this patent is extended or adjusted under 35 U.S.C. 154(b) by 0 days.

(21) Appl. No.: 10/893,724

(22) Filed: Jul. 19, 2004

(51) Int. Cl.
*A63B 55/10* (2006.01)

(52) U.S. Cl. ..... 473/282

(58) Field of Classification Search ..... 473/282, 473/286, 408; 248/156, 439; D27/796; 211/70.2
See application file for complete search history.

(56) References Cited

U.S. PATENT DOCUMENTS 1,443,230 A 1/1923 Luckett
D279,309 S * 6/1985 Rosen et al. ..... D21/793
4,545,579 A 10/1985 McCain
4,913,389 A 4/1990 McCracken
5,076,581 A 12/1991 Boberg
5,143,371 A * 9/1992 Strahan ..... 473/285
5,467,980 A 11/1995 Weisenstein
5,730,404 A * 3/1998 Evans et al. ..... 248/156
6,315,133 B1 * 11/2001 Franke ..... 211/70.2
6,572,487 B1 6/2003 Ruff

* cited by examiner

*Primary Examiner*—Stephen Blau
(74) *Attorney, Agent, or Firm*—George L. Williamson

(57) ABSTRACT

The present invention discloses a rest for the handle of a golf club which rest can be placed in a supporting surface; e.g., the ground, and the handle rested thereon so that the handle of the golf club does not get wet from the dew or other moisture on the grass or the ground. The present invention discloses a plate having a plurality of semi-circular apertures on its top edge for supporting the handle of a golf club along with a spike-like member disposed on its bottom edge which can be used to stick into the ground so that the present invention is supported by the ground.

1 Claim, 1 Drawing Sheet

GOLF CLUB REST

BACKGROUND OF THE INVENTION

1. Field of the Invention

The present invention relates generally to golf clubs and, more particularly, is concerned with a rest or holder for the handle of a golf club.

2. Description of the Prior Art

Golf club handle holders have been described in the prior art; however, none of the prior art devices disclose the unique features of the present invention.

In U.S. Pat. No. 6,572,487 B1, dated Jun. 3, 2003, Ruff disclosed a unitary golf club rest which includes a golf club support at one end and a turf piercing element at the other end. A foot press is situated between the two ends. The golf club support is roughly V-shaped with a cushioned surface, and also acts as a handle for the golf club rest. The turf piercing element has a blunted tip. The foot press also acts to stabilize the golf club rest when placed in the ground, as well as a stop for the golf club rest.

In U.S. Pat. No. 5,076,581, dated Dec. 31, 1991, Boberg disclosed a prop for spacing a handgrip of a golf club from the ground such that when the golf club is laid thereupon, the handgrip remains dry and clean. The prop includes a body having a generally round aperture extending therethrough about a longitudinal axis with the aperture being sized and configured to retain the handgrip therewithin. The body also has spaced surfaces which form a slot opening radially outwardly from the aperture. The slot is sufficiently large to allow the shaft to radially enter, and sufficiently small to prevent the handgrip from exiting, the aperture. The prop may be radially inserted into the slot until the shaft is received within the aperture. The prop may then be slid longitudinally along the shaft and over the handgrip with the aperture being retainable about the handgrip. The prop has a peripheral portion configured such that when a golf club, with the prop located thereon, is placed on the ground in any angular configuration relative to the ground, the handgrip will remain radially spaced from the ground. Preferably, the configuration of the peripheral portion is generally circular.

In U.S. Pat. No. 5,467,980, dated Nov. 21, 1995, Weisenstein disclosed a device for supporting at least a portion of a golf club relative to a ground surface. The inventive device includes a ground engaging assembly for piercing and engaging a ground surface. A handle engaging assembly is coupled to an upper end of the ground engaging assembly for receiving a handle of a golf club to support the golf club in a leaning or suspended position relative to the ground surface.

In U.S. Pat. No. 1,443,230, dated Jan. 23, 1923, Luckett disclosed a kit having separate open compartments for the reception of the shank portions of golf sticks, the compartments being preferably arranged in the body of the kit so that the sticks when supported therein will be inclined toward each other and will tend to contact with each other at a point remote from the kit but, in substantial alignment with the longitudinal axis thereof, to facilitate carrying the kit which is, of course, also provided with a hand grip and shoulder engaging strap as well as ball receiving means.

In U.S. Pat. No. 4,991,939, dated Feb. 12, 1991, Lumbattis, Jr., disclosed a small hand-held device including a grommet for encircling the handgrip end of a golf club and for supporting a golf club in a generally prone position on a wet grass surface, with the handgrip portion of the club slightly elevated above the tip ends of the blades of grass. The handgrip portion of the club will remain dry (and usable) even though the grass is wet, e.g., due to rain and/or sprinkling of the grass and/or early morning dew. The device is useful primarily around the putting greens of the golf course, where a player may wish to carry only a putter and a chipping iron while moving to a ball located a short distance off the green.

In U.S. Pat. No. 4,913,389, dated Apr. 3, 1990, McCracken disclosed a one-piece holder for shooting targets, archery targets, yard signs and the like which has a first crossbar with a clip at each end having a toothed notch into which the target sign or sign suitable for the named purposes may be inserted. The first crossbar is supported by an upright which has a second crossbar at its lower end with earth-penetrating prongs extending downward therefrom, enabling the user to press the prongs into the ground with his foot, so as to support the holder and, therefore, the target or sign, vertically.

In U.S. Pat. No. 4,545,579, dated Oct. 8, 1985, McCain disclosed a golf club and golf club support including support means for holding the golf club handle high enough above the ground to keep the grip clean and dry when the golf club is laid down in the course of a game of golf.

While these golf club handle holders may be suitable for the purposes for which they were designed, they would not be as suitable for the purposes of the present invention, as hereinafter described.

SUMMARY OF THE PRESENT INVENTION

The present invention discloses a rest for the handle of a golf club which rest can be placed in a supporting surface; e.g., the ground, and the handle rested thereon so that the handle of the golf club does not get wet from the dew or other moisture on the grass or the ground. The present invention discloses a plate having a plurality of semi-circular apertures on its top edge for supporting the handle of a golf club along with a spike-like member disposed on its bottom edge which can be used to stick into the ground so that the present invention is supported by the ground.

An object of the present invention is to provide a device for supporting the handle of a golf club. A further object is to provide a supporting member which can be carried about easily by the user. A further object of the present invention is to provide a holder for a golf club handle which can be manufactured easily and simply.

The foregoing and other objects and advantages will appear from the description to follow. In the description reference is made to the accompanying drawings, which form a part hereof and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 2:
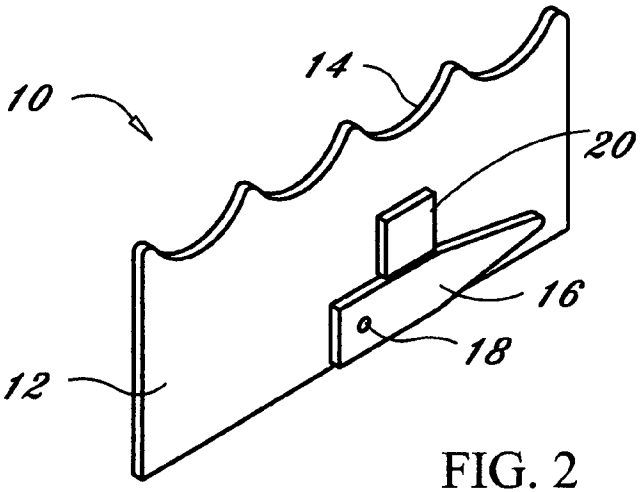
FIG. 2 is an elevation view of the present invention.

With regard to reference numerals used, the following numbering is used throughout the drawings.

| | |
|---|---|
| 10 | present invention |
| 12 | plate |
| 14 | apertures |
| 16 | spike |
| 18 | pivot |
| 20 | stop |
| 22 | golf club |
| 24 | ground |

DETAILED DESCRIPTION OF THE PREFERRED EMBODIMENT

Turning now descriptively to the drawings, in which similar reference characters denote similar elements throughout the several views, wherein the figures illustrate the present invention wherein a rest for the handle of a golf club disclosed.

Figure 1:
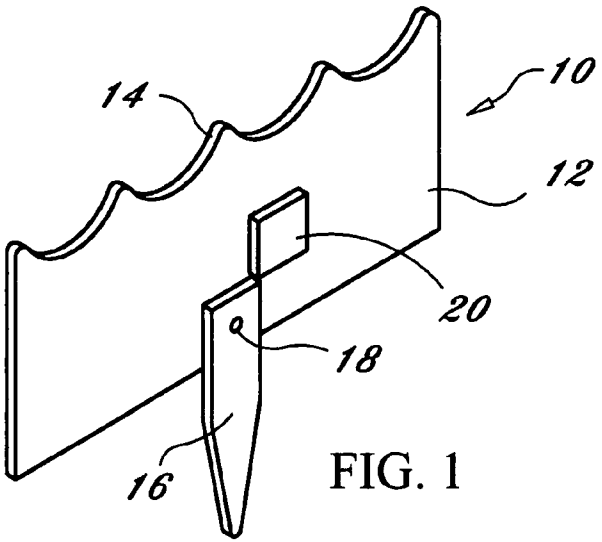
FIG. 1 is a perspective view of the present invention.

Turning to FIG. 1, shown therein is the present invention 10. The present invention has a plate-like member 12 which has a plurality of semi-circular apertures or cutouts 14 disposed on its upper edge. This plate 12 is designed to be upright-standing by having the spike 16 stuck into the ground or other supporting surface. The spike 16 has a point thereon which allows it to be stuck into the ground. Spike 16 is disposed on a pivot 18 which allows it to be rotated about 90 degrees to a horizontal position wherein it can be stored. Also shown is stop 20 which provides a stop for spike 16 so that it is held in a parallel position with the bottom edge of plate 12.

Turning to FIG. 2, shown therein is the present invention 10 with spike 16 in a folded position for storage. The present invention has a plate-like member 12 which has semi-circular apertures or cutouts 14 disposed on its upper edge. This plate 12 is designed to be upright-standing by having the spike 16 stuck into the ground or other supporting surface. The spike 16 has a point thereon which allows it to be stuck into the ground. Spike 16 is disposed on a pivot 18 which allows it to be rotated about 90 degrees to a horizontal position wherein it can be stored. Also shown is stop 20 which provides a stop for spike 16 so that it is held in a parallel position with the bottom edge of plate 12.

Figure 3:
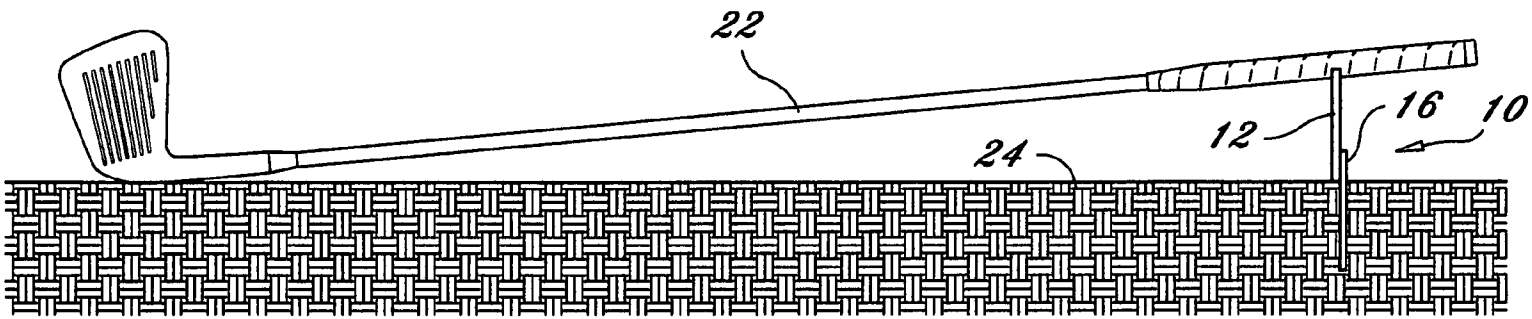
FIG. 3 is a perspective view of the present invention in use.

Turning to FIG. 3, shown therein is the present invention 10 having a golf club 22 resting thereon. The present invention has a plate-like member 12 which has a plurality of semi-circular apertures or cutouts 14 disposed on its upper edge. This plate 12 is designed to be upright-standing by having the spike 16 stuck into the ground 24 or other supporting surface. The spike 16 has a point thereon which allows it to be stuck into the ground. Note that a plurality of golf clubs 22 can be rested on the present invention at the same time depending on the number of semi-circular cutouts therein.

I claim:

1. A rest in combination with a handle of a golf club for supporting said handle on a supporting surface, comprising:

a) a plate having an upper and lower edge, and a front and rear surface;

b) a plurality of notches being disposed on said upper edge of said plate, wherein said handle of a golf club can be rested thereon;

c) a spike being disposed on said front surface of said lower edge of said plate to permit the spike to be stuck into the supporting surface so that the rest for said handle of the golf club can be upright standing;

d) wherein said spike be rotated 90 degrees from a first position perpendicular to said lower edge of said plate to a second position parallel to said lower edge of said plate; and, e) a stop being disposed on said front surface of said plate for securing said spike in a position parallel to said lower edge of said plate.

* * * * *